US007119648B1

(12) United States Patent
Herbert

(10) Patent No.: US 7,119,648 B1
(45) Date of Patent: Oct. 10, 2006

(54) COAXIAL PUSH PULL TRANSFORMERS FOR POWER CONVERTERS AND LIKE CIRCUITS

(76) Inventor: Edward Herbert, 1 Dyer Cemetery Rd., Canton, CT (US) 06019-2029

( * ) Notice: Subject to any disclaimer, the term of this patent is extended or adjusted under 35 U.S.C. 154(b) by 38 days.

(21) Appl. No.: 10/904,371

(22) Filed: Nov. 6, 2004

Related U.S. Application Data

(63) Continuation-in-part of application No. 10/708,846, filed on Mar. 27, 2004, now Pat. No. 7,023,317, and a continuation-in-part of application No. 10/709,484, filed on May 8, 2004, now Pat. No. 6,979,982.

(60) Provisional application No. 60/460,333, filed on Apr. 3, 2003, provisional application No. 60/473,075, filed on May 23, 2003, provisional application No. 60/479,706, filed on Jun. 19, 2003.

(51) Int. Cl.
*H01F 17/06* (2006.01)

(52) U.S. Cl. ..... 336/175; 363/24

(58) Field of Classification Search ..... 336/174, 336/175; 363/24
See application file for complete search history.

(56) References Cited

U.S. PATENT DOCUMENTS 5,093,646 A * 3/1992 Herbert ..... 336/225
6,137,392 A * 10/2000 Herbert ..... 336/175
6,529,389 B1 * 3/2003 Perlick et al. ..... 363/20

* cited by examiner

*Primary Examiner*—Anh Mai

(57) ABSTRACT

A coaxial push pull transformer is an improved matrix transformer. A number of magnetic cores each contain a pre-wired secondary circuit. The secondary windings are tubular and extend through the core, and the ends of the tubular secondary windings are terminated to make connections to a secondary circuit, such as rectifiers. The cores are placed end to end with the tubular secondary windings aligned and the primary winding is then threaded through all of the cores, so that it is coaxial with the secondary windings when installed, for very low leakage inductance. In the design of the coaxial push pull transformer, care is taken to arrange the terminations of the transformer such that each termination is paired with another termination having a counter-flowing current, to cancel part of the field caused by the flowing currents so as to reduce the overall inductance of the terminals and interconnections. To keep the interconnections to the associated circuitry as short as possible, the associated circuitry may be on circuit boards sandwiched between the transformer cores and directly connected to its terminations.

9 Claims, 10 Drawing Sheets

COAXIAL PUSH PULL TRANSFORMERS FOR POWER CONVERTERS AND LIKE CIRCUITS

CROSS REFERENCE TO RELATED APPLICATIONS

This patent application is a continuation in part of a patent application entitled Cellular Transformers, Ser. No. 10/708,846, filed 27 Mar., 2004 now U.S. Pat. No. 7,023,317 and a provisional patent application entitled Cellular Transformers, Ser. No. 60/460,333 filed 3 Apr., 2003. Priority to these dates is claimed.

This patent application is also a continuation in part of a patent application entitled Switched-Current Power Converter, Ser. No. 10/709,484, filed 8 May 2004, which issued as U.S. Pat. No. 6,979,982 on 27 Dec., 2005; a provisional patent application entitled Switched-current Power Converter, Ser. No. 60/473,075 and filed 23 May, 2003; and a provisional patent application entitled Parallel Current Sources for Switched-Current Power Converters, Ser. No. 60/479,706, and filed 19 Jun., 2003. Priority to these dates is claimed. These patent applications are incorporated herein by reference.

BACKGROUND OF THE INVENTION

To make power converters and like circuits using transformers smaller and more responsive, there is a trend toward using higher and higher frequency excitation. A major obstacle is the parasitic impedances of the transformers, particularly the leakage inductance, both of the windings and of the leads, interconnections and connected circuitry.

The prior art "matrix transformer", sometimes called a "flat transformer", significantly reduced the leakage inductance of the windings, but there is a need for yet more improvement. A matrix transformer may have a single turn primary which passes through a number n of interdependent "elements". The elements are separate magnetic cores with their associated secondary windings, and often the elements are assembled as "modules" with through holes through which the primary is threaded at final assembly.

A matrix transformer with a single turn primary and n elements will have a ratio of n to one. Because the primary is a single winding passing through all the elements, the currents are constrained to be equal in each element. Usually the secondary windings of the elements are connected in parallel, either directly or at the output of associated rectifier circuits, so the voltages in the elements (and thus the fluxes) are also constrained to be equal.

The patent applications cited above for cellular transformers teach an embodiment of the cellular transformer having cellular metal inserts through which a multiple turn primary winding is wound. With a hole for each turn, each active section of the primary winding has a coaxial location within the hole, for very good coupling and low leakage inductance.

The patent applications cited above for switched-current power converters show diagrammatically matrix transformers wherein the coaxial winding is applied to matrix transformer elements having a single turn primary.

SUMMARY OF THE INVENTION

In a transformer, the magnetic core must be excited with alternating voltage so that the integral of the flux over time is zero. This may be accomplished with a single winding in which the polarity alternates positive and negative with equal volt-seconds. In a push-pull transformer the same polarity voltage is used, but it is applied alternately to separate windings having opposite phasing. In a conventional transformer this may be a winding with a center-tap or a split winding, but in as much as only one section of the winding is conducting at any one time, it is the turns of the section that determines the ratio of the transformer. Thus a two turn center-tapped or split winding used in a push-pull transformer is a "single turn push-pull winding".

This invention teaches a coaxial push pull transformer having two coaxial windings, the outer conductor of each being a secondary winding and the inner conductor of each being a primary winding. The coaxial relationship between the primary and secondary windings with the secondary windings surrounding the primary winding has very good coupling for minimal leakage inductance. This invention teaches if that both the primary winding and the secondary windings are push-pull windings, the windings are phased such that when one of the primary conductors is conducting, the secondary winding that surrounds it coaxially will also be conducting so that the currents therein are very closely coupled.

This invention teaches that in a transformer having a coaxial push-pull secondary winding that is used in a topology usually having one winding primary, such as a half-bridge or full-bridge power converter primary circuit, it is preferred, none-the-less, to use two primary windings in parallel, one passing through the secondary windings of one phase and the other passing through the secondary windings of the other phase.

While the coaxial relationship of the primary and the secondary windings ensures a very low leakage inductance within the coaxial push-pull transformer, care must be taken to ensure that the interconnections and external circuits also have low leakage inductance or the benefits of the coaxial push-pull transformer may be swamped. This invention teaches that the various terminations of the coaxial push-pull transformer should be arranged and disposed such that each conductor is closely proximate to another conductor in which an equal current flows in the opposite direction (counter-flows) for field cancellation to reduce the inductance therein.

This invention teaches that the external connections should be minimized to avoid undue inductance in the external connections. This invention teaches that the switching components (solid state switches and rectifiers) may be incorporated within a modular design very close to the transformer windings and the magnetic core. The module may incorporate two elements with their secondary windings terminated on a common circuit board that is sandwiched between them. Further, if there is a first switching component on one side of the board that conducts in one direction when its associated phase is conducting, it is preferred to locate the complementary (same phase) switching component on the opposite side of the board so that when the first switching component is conducting, the one on the opposite side is also conducting but with current flow in the opposite direction (counter-flowing) to reduce the inductance of the circuit.

This invention teaches a transformer having extended insulation between the primary and secondary winding terminations for dielectric isolation and to meet creepage requirements wherein the primary windings returns in a coaxial outer conductor that surrounds the extended insulation and returns the current to a plane so that the current therein can be located closely proximate to a counter-flowing current in the secondary circuit.

This invention teaches push-pull secondary windings (center-tapped or split) with a rectifying means incorporated into a modular design so that the connections to the external circuits carry only a dc current.

This invention also teaches alternate embodiments of the invention employing symmetrical push-pull windings, either in the primary circuit or the secondary circuit or both.

This invention teaches a coaxial secondary winding that uses very simple stamped and formed parts.

A variant of the push-pull transformer is the double forward transformer, which can be explained as a push-pull transformer in which the two halves of a push-pull winding are in separate cores. In a push-pull transformer the alternate voltage of the same polarity but opposite phasing ensures that the integral of the flux over time is zero, but when the windings are in separate cores, this mechanism is lost. Accordingly, a means for resetting the flux must be incorporated into the design of such power converters. A variety of such circuits are well known to one skilled in the art of power converters. As long as the circuit does not depend upon high leakage inductance within the transformer, such circuits can be used to energize a double forward coaxial transformer.

Another embodiment of the invention uses two single triaxial windings, each in a separate core, to implement a double forward transformer topology. The triaxial winding uses the outer conductor as a secondary winding, the next conductor as a primary winding and the innermost conductor as a reset winding.

This invention also teaches the use of a "folded" element comprising two cores of half the length, so that odd integer ratio transformers may be fabricated. This invention also teaches that a module incorporating a symmetrical push-pull winding is inherently "folded" so that an odd number can be used for an odd integer ratio of the transformer.

DETAILED DESCRIPTION

Figure 1:
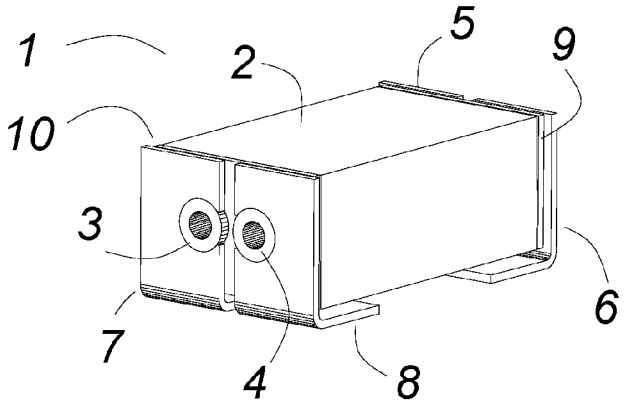
FIG. 1 shows a coaxial push-pull module comprising a magnetic core and the secondary windings of an element of a coaxial push pull transformer.

FIG. 1 shows a module 1, which will become an "element" of a coaxial push pull transformer once a primary winding is installed. A coaxial push pull transformer is an improved matrix transformer (sometimes known as a "flat transformer). The prior art matrix transformer is well described in a tutorial written by the inventor entitled "Design and Application of Matrix Transformers and Symmetrical Converters", for a seminar presented at the Fifth International High Frequency Power Conversion Conference '90 Santa Clara, Calif., May 11, 1990.

Figure 2:
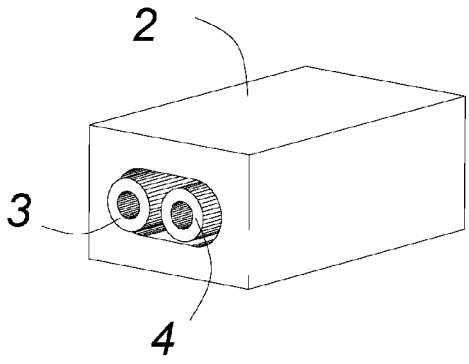
FIG. 2 shows a magnetic core and the outer coaxial conductors of the module of FIG. 1.

The design of the module 1 is best introduced by FIG. 2, which shows a magnetic core 2 with two tubular secondary windings 3 and 4 passing through a hole therein. FIG. 1 shows that two insulating pieces 9 and 10 may be used to insulate and locate the tubular secondary windings 3 and 4.

The tubular secondary windings 3 and 4 may then be terminated by surface mount terminations 5, 6, 7 and 8 for making an electrical connection to external circuitry. Like reference designator indicate the same part in the different figures.

Figure 3:
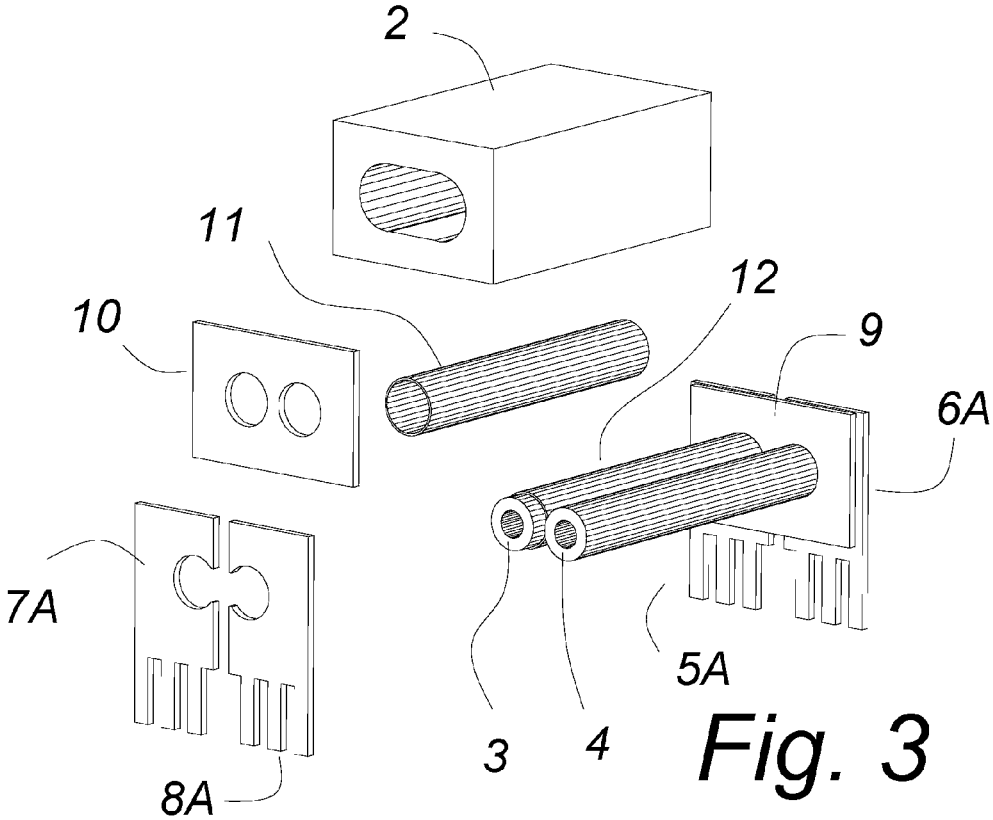
FIG. 3 shows an exploded view of a module of a coaxial push pull transformer.

FIG. 3 shows in an exploded view that the tubular secondary windings 3 and 4 may be further insulated by insulation sleeves 11 and 12. FIG. 3 also shows alternative terminations 5A, 6A, 7A and 8A, modified for through-hole installation in a printed wiring board. Various means for making a connection to the secondary windings 3 and 4 may be used, and all would be equivalent for this invention. As an alternative to using insulating sleeves 11 and 12, the tubular secondary windings 3 and 4 may be coated or jacketed with insulation which may be stripped at the ends to enable connection to the terminations A, 6A, 7A and 8A. As another alternate yet, the tubular secondary windings may be un-insulated but with the separation between them maintained by a physical spacer and the magnetic core 2 may be coated with insulating material.

In FIGS. 1 and 3, the terminations of the module are undedicated and may be connected externally to comprise a center-tapped or split push-pull winding. For example, if terminal 6 is connected externally to terminal 7, the connection is the center-tap, and terminals 4 and 8 are the "start" and "end", to borrow terminology from the art of conventional wound transformers.

Figure 4:
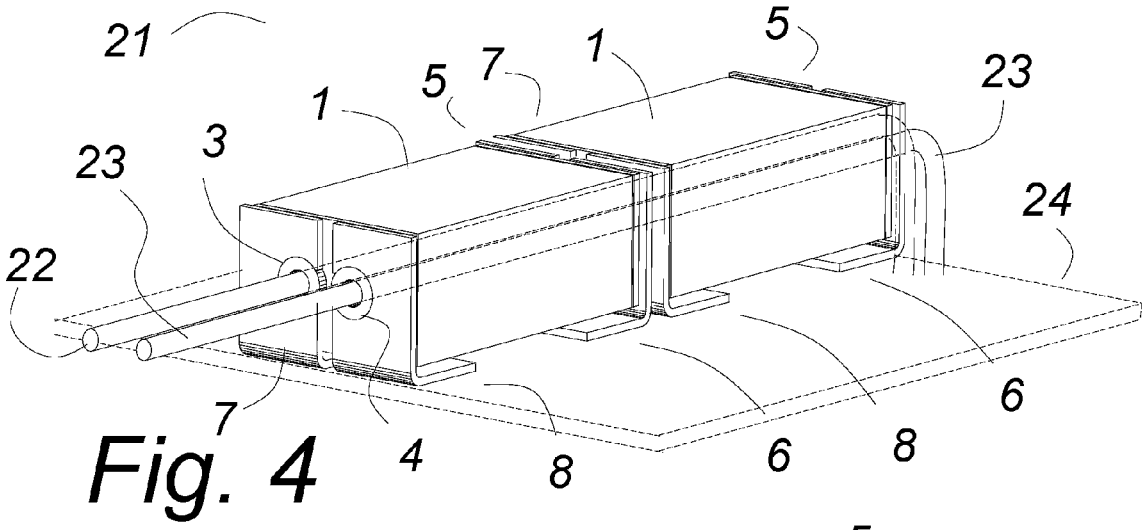
FIG. 4 shows two elements of a coaxial push pull transformer with segments of a primary winding installed in two modules of the coaxial push-pull transformer.

FIG. 4 shows two elements of a coaxial push pull transformer 21 comprising two of the modules 1 of FIG. 1 mounted on a printed wiring board 24. Primary windings 22 and 23 pass through the modules 1, 1. Having such long exposed portions of the primary windings 22 and 23 is not preferred, and it is shown here for illustration purposes only. Long exposed portions of the primary winding 22 and 23 would increase the leakage inductance unacceptably.

Figure 5:
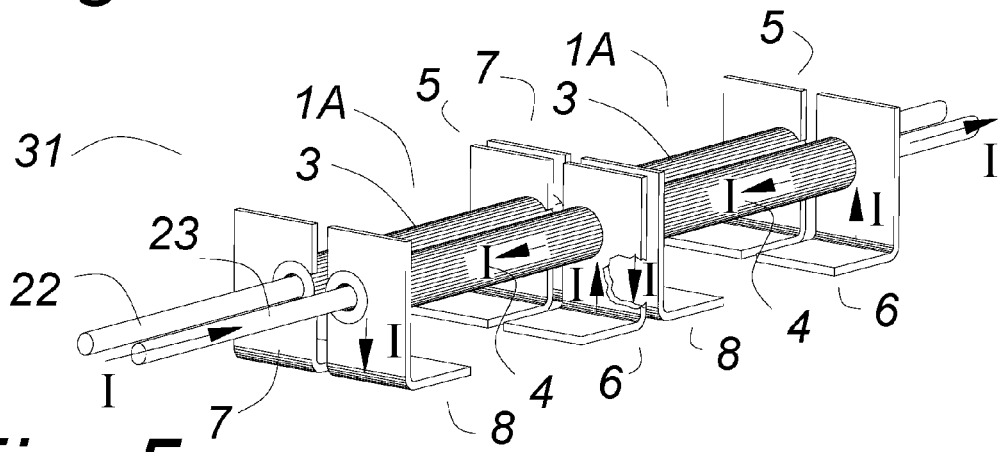
FIG. 5 shows the two elements of the coaxial push pull transformer of FIG. 4, less the magnetic cores, with segments of a primary winding installed therein, and with current flow indicated by arrows.

FIG. 5 shows two elements of a coaxial push pull transformer 31 which is the transformer 21 of FIG. 4 with the magnetic cores removed, their absence from the modules 1, 1 of FIG. 4 being indicated by the new references 1A, 1A. In as much as the transformer will not operate without its magnetic cores, this is for illustration only, to better show the conductors and the current flow therein, indicated by arrows and the magnitude I. A current I enters the left end of the primary 23 and continues to flow from the right end to other elements of the transformer or other circuitry. Because the net ampere turns in a transformer must equal zero (neglecting magnetization currents), an equal and opposite current flows in the secondary windings 4, 4 and their terminations 6, 6, 8 and 8, as indicated by the arrows and the magnitude I. It is assumed that the current is blocked from flowing in the primary winding 22 and the secondary windings 3, 3, as by open switches or reverse biased rectifiers or the like, as illustrations, not limitations, as is usually the case with push-pull windings.

Figure 6:
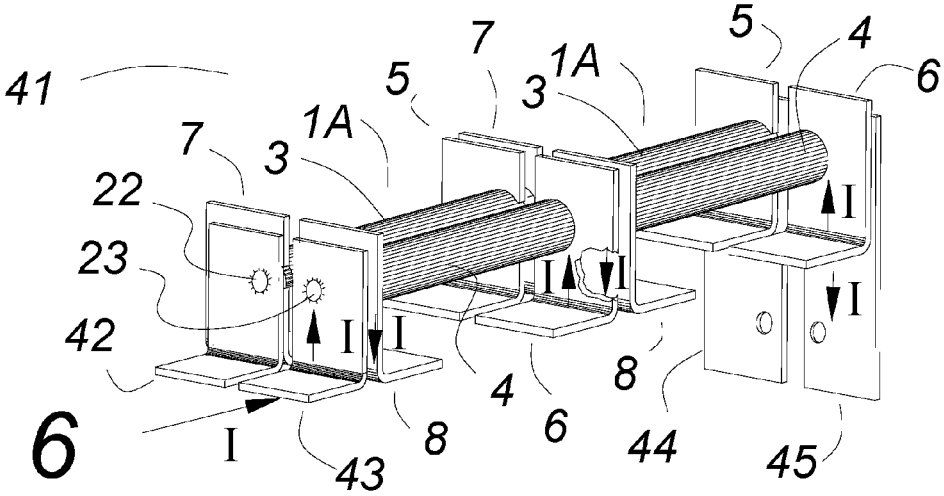
FIG. 6 shows two elements of a coaxial push pull transformer, less the magnetic cores, with segments of a primary winding installed therein and terminated. Arrows indicate the current flow.

At the central part of the drawing FIG. 5 of the portion of the coaxial push pull transformer 31, note that the currents flowing in the termination means 6 and 8 are equal and opposite, or "counter flowing", a condition that significantly reduces the leakage inductance in those conductors by partly canceling the magnetic field associated with the flowing current. This is not the case at the ends of the transformer 31, as there is no adjacent elements at those locations. FIG. 6 shows that counter flowing currents can be achieved at the ends of the transformer as well by using parallel conductors 42, 43, 44 and 45 as terminations for the primary windings 22 and 23. Having wide parallel conductors with counter flowing currents is preferred for reducing the leakage inductance of the terminations.

Figure 7:
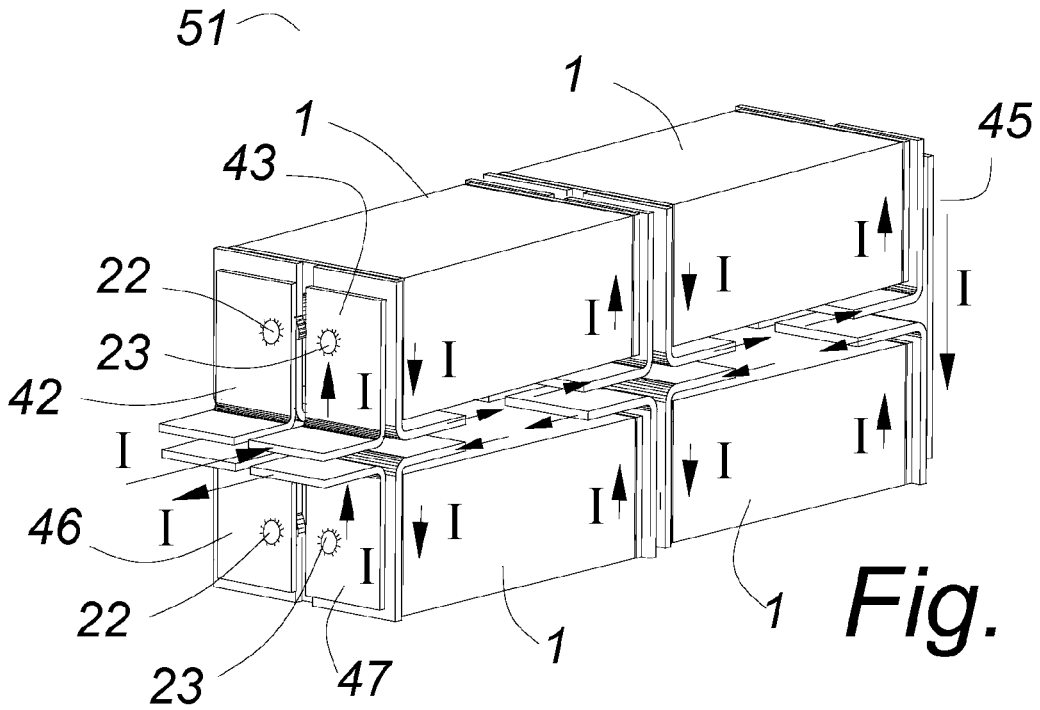
FIG. 7 shows a coaxial push pull transformer having four elements. Arrows indicate the current flow.

FIG. 7 shows a complete coaxial push pull transformer 51 having four elements. The turns ratio will be four to one. It is based upon the partial coaxial push pull transformer 41 of FIG. 6, changed as follows: The modules 1—1 showing the magnetic cores 2—2 (with reference to FIGS. 1 through 3) in place to replace the modules 1A, 1A of FIG. 6. Two additional modules 1—1 have been included, two additional termination means 46 and 47 have been added, and the primary windings 22 and 23 are extended so that the currents therein pass through all of the modules 1—1 in series. The external connecting link 45 for the primary winding 23 can be seen on the right. It can be seen that in all of the conductors of the coaxial push pull transformer 51 each current is balanced by an equal and opposite counter flowing current, for low leakage inductance. A coaxial push-pull transformer of any even integer turns ratio may be made by using more or fewer elements in pairs.

Note that the coaxial push pull transformer 51 is "folded" so that if one follows the primary windings 22 and 23 through the entire transformer, they form a closed loop, returning so that their termination means 42, 43, 46 and 47 are in a tight cluster and have counter flowing currents therein. Connections are preferable made to external circuits very close to the termination means 42, 43, 46 and 47, and may include a "center-tap" connection to a power source and connections to two switching means as push pull switches to return, as an illustration, not a limitation.

Figure 8:
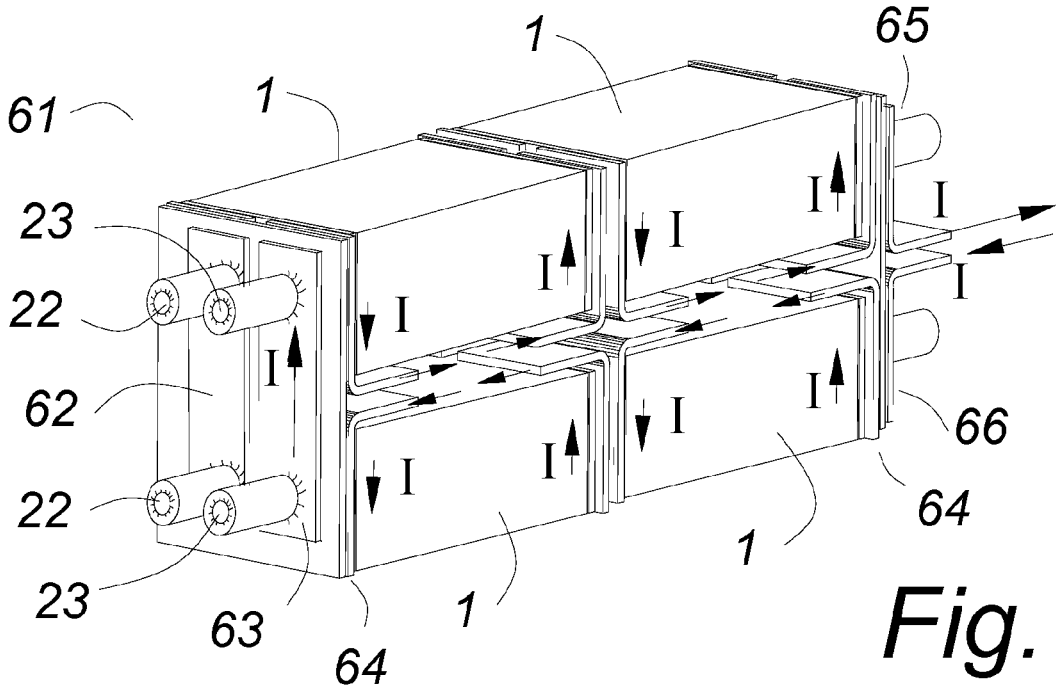
FIGS. 8 and 9 show a method of terminating a primary winding of a coaxial push-pull transformer for minimum leakage inductance while still providing the creepage distance required for dielectric isolation.
Figure 9:
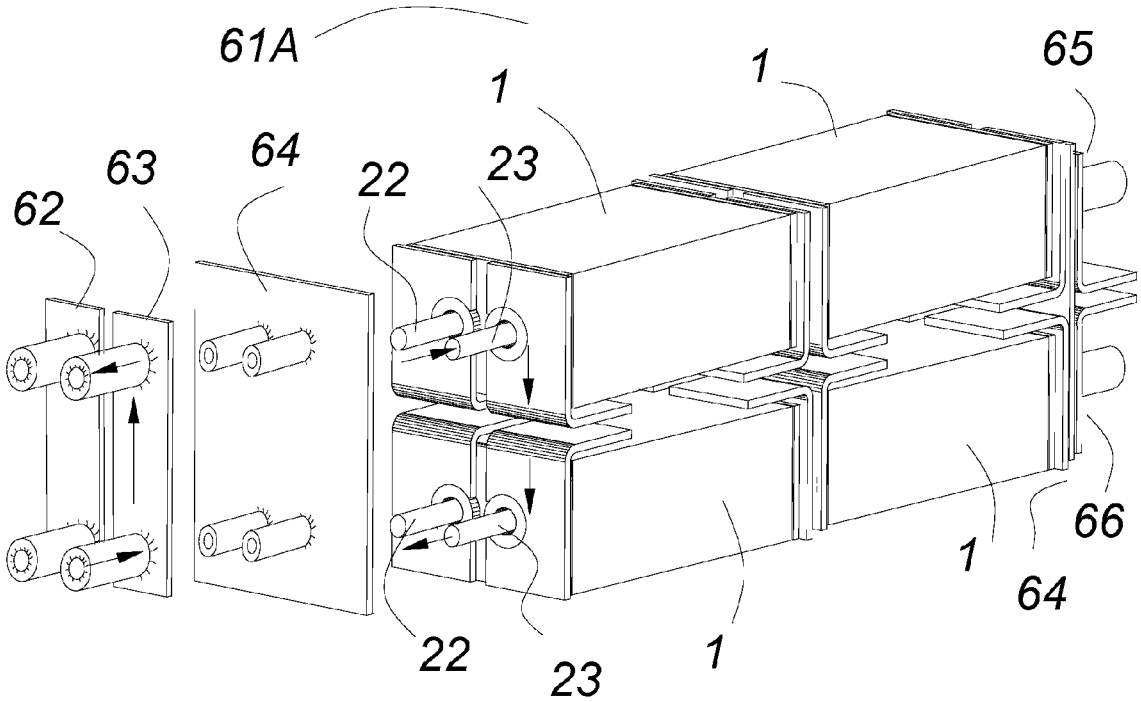

The coaxial push pull transformer 51 of FIG. 7 has the limitation that the closely spaced parallel terminations of the primary winding and the secondary winding may not provide adequate creepage distance for safety isolation requirements unless it is potted or otherwise sealed to block the through-the-air creepage paths. FIGS. 8 and 9 show a transformer 61, which is a modification of the transformer 51 of FIG. 7 to achieve as long a creepage path as is necessary. In FIG. 9, the transformer is designated 61A, to distinguish the exploded view. It is assumed that the primary winding wires 22 and 23 are suitably insulated, probably double or triple insulated, as an illustration, not a limitation. The ends of the wires of the primary windings 22 and 23 may be extended beyond the secondary conductors as far as is necessary to meet the creepage specification from the stripped end of the wires of the primary winding 22 and 23 to the secondary winding terminations.

Insulating means 64, 64 are then placed over the ends of the wires of the primary windings 22 and 23, one at each end. The insulating means 64, 64 may be molded plastic parts, as an illustration, not a limitation, having sufficient thickness and mechanical integrity to meet the dielectric insulation requirements. The insulating means has cylindrical extensions rising from a plane surface to surround the ends of the wires of the primary windings 22 and 23 and insulate them.

Then, termination means 62, 63, 65 and 66 may be installed over the insulating means 64, 64. Hollow cylindrical extensions extend from the plane of the termination means 62, 63, 65 and 66 to engage the stripped ends of the wires of the primary windings 22 and 23 and are connected thereto as by soldering, as an illustration, not a limitation. The hollow cylindrical extensions then return the current to the plane surfaces of the termination means 62, 63, 65 and 66 as coaxial, counter flowing currents for low leakage inductance. The plane surfaces of the termination means 62, 63, 65 and 66 are now close to the secondary conductors as in FIG. 7 so that counter flowing currents therein will minimize the leakage inductance therein.

Figure 10:
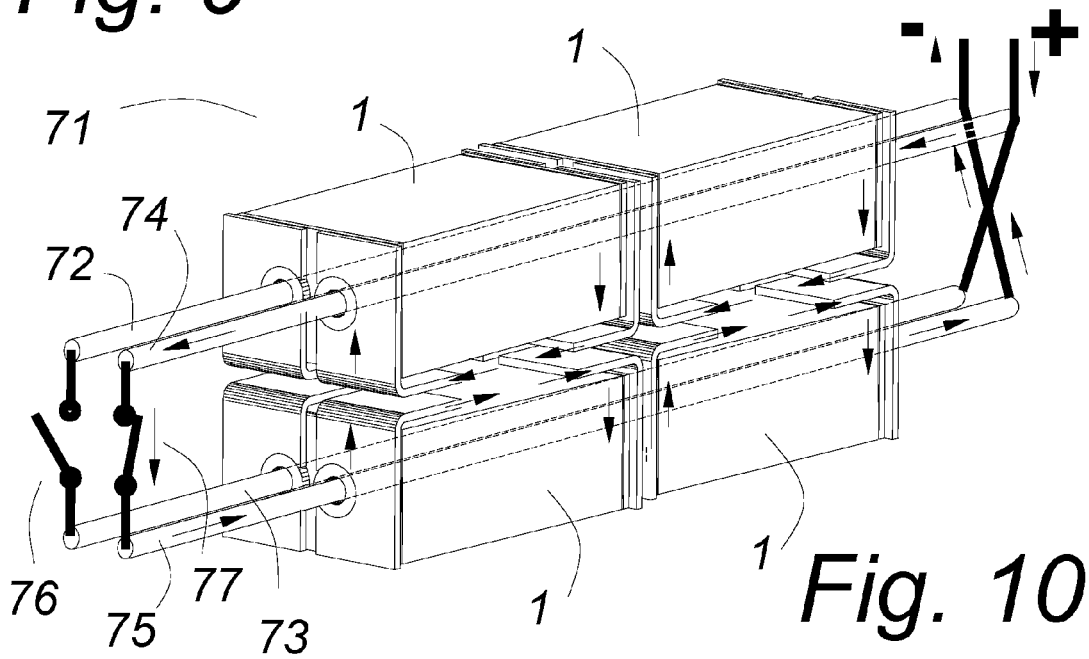
FIG. 10 shows a coaxial push pull transformer having a symmetrical push pull primary winding, exaggerated for clarity.

FIG. 10 shows a coaxial push pull transformer 71 having four elements and comprising four modules 1—1 of FIG. 1. A primary winding comprising conductors 72 through 75 passes through the modules 1—1 and is connected as a symmetrical push pull winding. The power input connections + and − are on the opposite ends of the coaxial push pull transformer 71 from two switching means 75 and 76. The primary windings 72 through 75 are shown much longer than is preferred, and the connections of the power input connections + and − and the switching means 75 and 76 are show in exaggerated scale for illustration only, to better show how the windings are connected.

Figure 11:
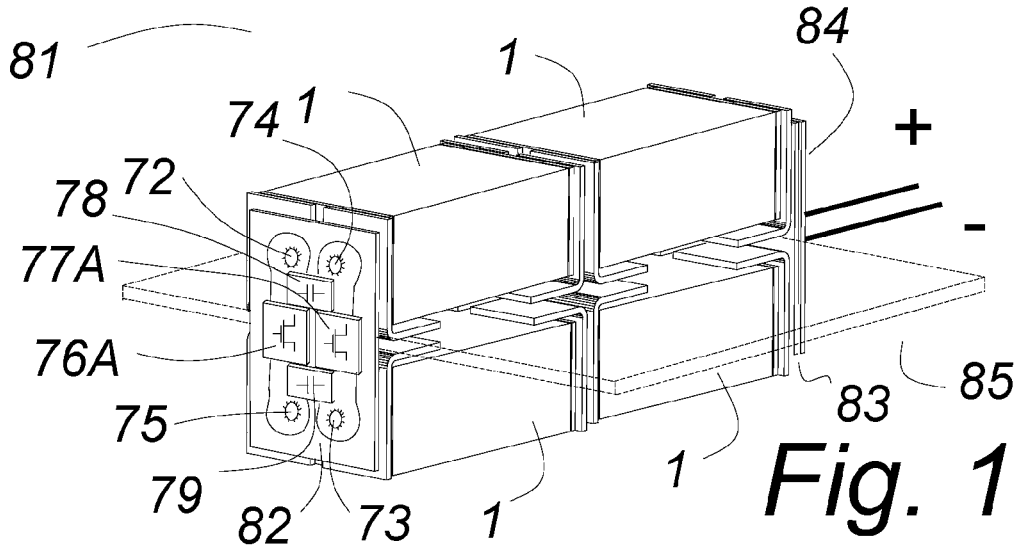
FIG. 11 shows that the switch end of the transformer of FIG. 10 may be implemented using MOSFET dice on a circuit board that is directly connected to the primary winding.
Figure 12:
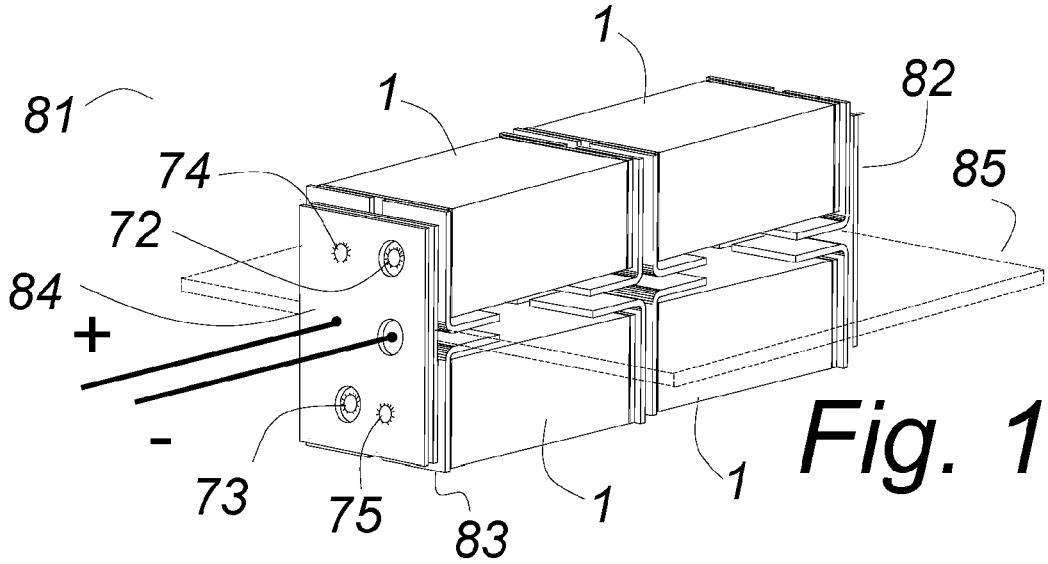
FIG. 12 shows that the connection end of the transformer of FIG. 10 may be implemented with power and ground planes that are directly connected to the primary winding.
Figure 30:
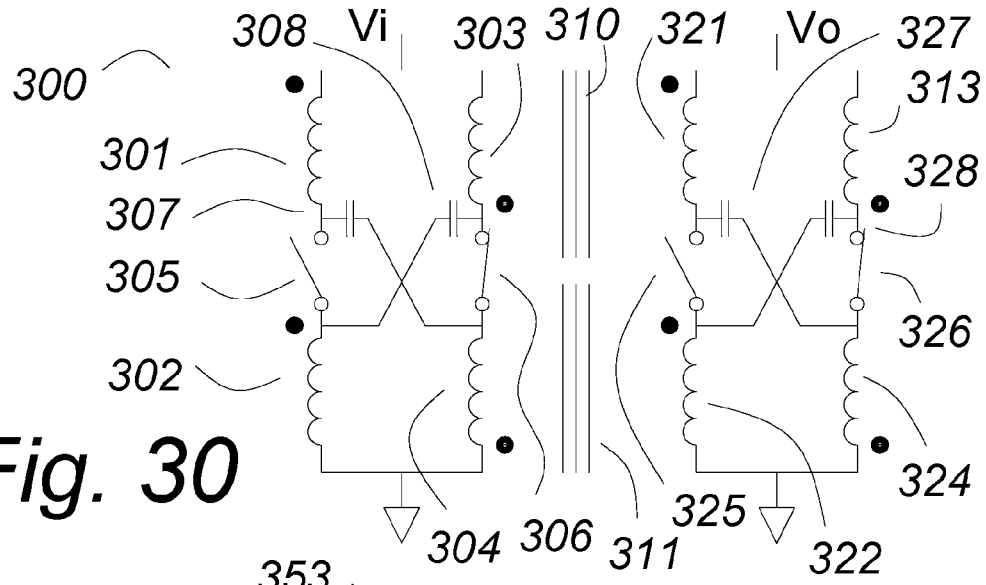
FIG. 30 shows a schematic of a transformer with symmetrical push pull primary and secondary windings.

FIGS. 11 and 12 show a coaxial push pull transformer 81 in which the switching means 76 and 77 of FIG. 10 have been replaced with MOSFET dice 76A and 77A. The MOSFET dice 76A and 77A may be mounted on a circuit board 82 to provide optimally short direct connections to the primary winding 72, 73, 74 and 75. "Floating capacitors" 78 and 79 may also be on the circuit board 82. The design and application of symmetrical converters and floating capacitors is explained in the tutorial referenced above, "Design and Application of Matrix Transformers and Symmetrical Converters". FIG. 30 shows a schematic diagram of the symmetrical push-pull transformer, and is discussed further below. In some instances, the area of the end of the transformer may not be large enough to have a conforming circuit board as shown. In that case, the circuit board may extend in one or more directions beyond the edge of the transformer. The circuit board may contain the switches, their drivers, perhaps logic and control circuitry, as an example, not a limitation.

The coaxial push pull transformer 81 may be connected to the power source + and − through power and ground planes 83 and 84 which connect directly to the primary winding 72, 73, 74 and 75, as shown in FIG. 12.

The modules 1—1 may sandwich a printed wiring board 85 that may contain the secondary connections and circuitry. These are not shown here but are discussed in more detail below. In the coaxial push pull transformer of FIGS. 11 and 12, only the primary winding is a symmetrical push pull winding. The four elements comprising the secondary circuits may be connected as a push-pull or spit winding.

Note that the symmetrical push-pull primary does not have to be terminated in a circuit board as shown in FIG. 11 nor in ground and power planes as shown in FIG. 12. An option would be to use the transformer of FIG. 7 with modified terminals, all similar to the terminals 42, 43, 46 and 47 on both ends. A single circuit board could be sandwiched in the transformer, extending beyond the sides and ends as necessary, and all of the circuit connections and associated components could be installed on the single circuit board.

A problem of "folded" matrix transformers, including coaxial push pull transformers, is that an equal number of modules may be used on each side, tending to limit the effective turns ratio to even numbers. For example, the coaxial push pull transformer 71 of FIG. 10 has four modules 1—1 and therefor an effective turns ratio of four to one. Adding or removing one module 1 to make a five to one or a three to one transformer respectively would make it difficult to have neat terminations with counter-flowing currents. One solution is to have cores that are longer than necessary to fill up the extra space. The extra flux capacity is beneficial though the conduction losses would be increased. The need for special parts is not desirable, but it would not be a serious limitation if the need were there.

Figure 13:
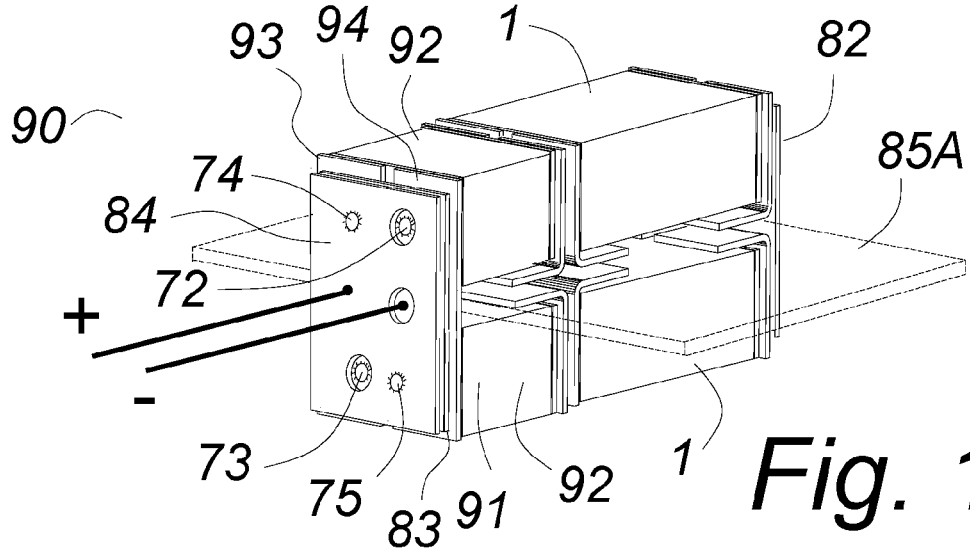
FIG. 13 shows the use of a folded element, to make a transformer with odd integer turns ratio.

An alternative embodiment is shown in FIG. 13, where the coaxial push pull transformer 90 is the coaxial push pull transformer 81 of FIG. 12 modified by removing two of the modules 1—1 and adding a "folded" module 91. The folded module 91 is equivalent to one of the modules 1 of FIG. 1, so the effective turns ratio of this transformer is three to one. The folded module 91 comprises two cores 92, 92, each of which is the same cross section but half the length of the core 2 of FIG. 1, so the total flux capacity is the same. The two halves of the folded module 91 are bridged by wide flat connection means 93 and 94, and the other secondary connections are not changed. The modules 1, 1 and 91 of the coaxial push pull transformer 90 may sandwich a printed wiring board 85A that may contain the secondary connections and circuits.

Figure 14:
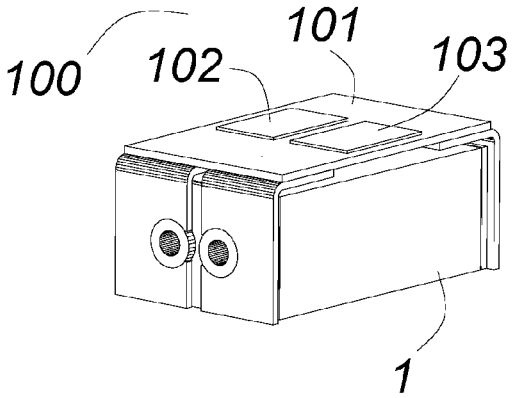
FIG. 14 shows the module of FIG. 1 further comprising a circuit board directly connected to its secondary terminations.
Figure 16:
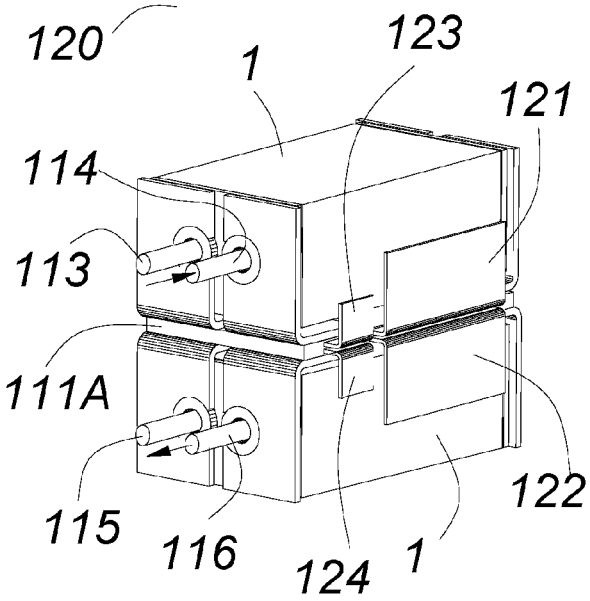
FIGS. 16 and 17 show how the module of FIG. 15 may be terminated with power and signal surface mount pads. All of the ac currents are confined to the module.

FIG. 14 shows a module 100 for a coaxial push pull transformer that is the module 1 of FIG. 1 (inverted) further comprising a circuit board 101 upon which are mounted two rectifier dice 102 and 103. While the connections of a transformer are somewhat discretionary, so long as phasing is observed, a representative connection, as an example, not a limitation, may use diagonally opposite terminations as a center-tap, perhaps terminals 6 (see FIG. 1 for the reference designators of the terminals) and 7, preferably connected together in a ground or power plane and perhaps terminated in a positive output terminal (not shown in FIG. 14, but an example is shown in FIG. 16 and discussed below). The other two terminals, 8 and 5 (see FIG. 1 for the reference designators of the terminals), may connect respectively to the rectifier dice 102 and 103, and they may in turn connect to another power or ground plane that may also be terminated as a negative output terminal (not shown in FIG. 14). In this manner, all of the ac circuits are confined to the module 100 with optimally short connections.

Figure 15:
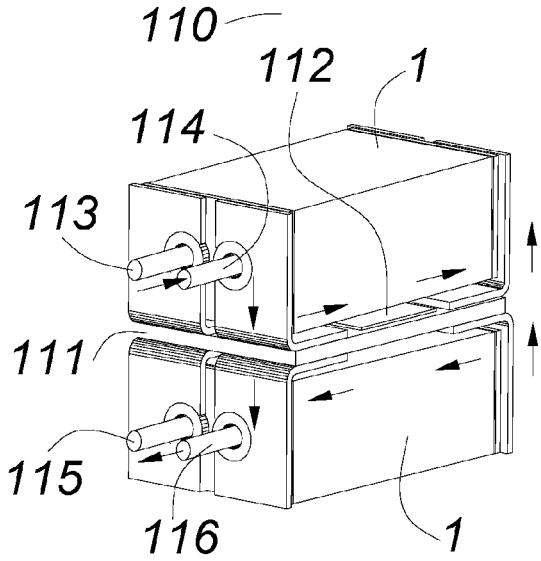
FIG. 15 shows that a pair of the modules of FIG. 14 may be used "back to back" with a common circuit board.

FIG. 15 shows this concept extended to a double module 110 which comprises two of the modules 1 of FIG. 1 sandwiching a circuit board 111 on which may be mounted four rectifier dice, one die 112 of which is shown. The arrows show that the circuit is well coupled with equal counter flowing currents for reduced leakage inductance. FIG. 15 also shows primary windings 113 through 116 in place within the module 110. This double module comprises two elements of a coaxial push pull transformer. Note in particular that the currents flowing in the circuit board 111 and through the rectifier die 112 are counter-flowing, left to right on the top and right to left on the bottom. Thus the cancellation of the magnetic field may be achieved in the switching devices as well, if they are carefully placed.

Note, however, that the module 110 of FIG. 115 is not constrained to any particular connection of its terminals nor any particular circuit upon its circuit board 111. As an example of an alternative winding arrangement and circuit, the module 110 of FIG. 15 may be connected as a symmetrical push-pull module, and switches and capacitors may be put on the circuit board 111. Another example of a symmetrical push-pull module is shown below in FIGS. 18 through 20 and a schematic diagram is shown in FIG. 30. If necessary, the circuit board 111 may extend beyond the edges of the modules 1, 1.

Figure 17:
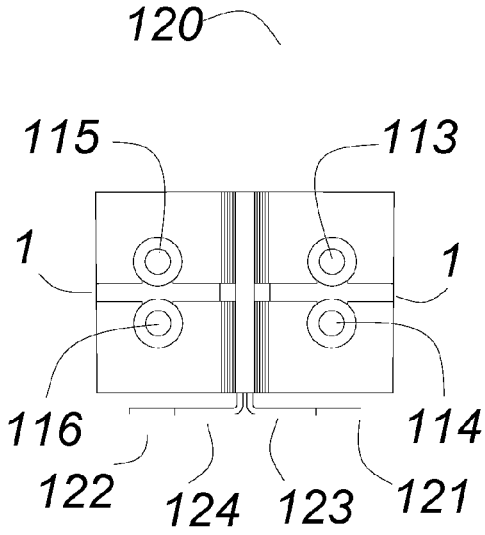

FIGS. 16 and 17 show the module 110 of FIG. 15 modified with an alternative circuit board 111A having power and return terminals 121 and 122, shown, as examples, not limitations, as fairly large surface mount terminals. The circuit board 111A may contain synchronous rectifiers (not shown) that may or may not include drivers. Regardless of the details of the circuit, which will vary from application to application as would be well known by one skilled in the art of power converters and transformers, the circuit board 111A may require timing and control signals from external circuits, and these may be brought to the circuit board by signal terminals, shown representatively as terminals 123 and 124. Fewer, more or no signal terminals may be needed for a particular application and the circuit board 111A may be modified accordingly.

Figure 18:
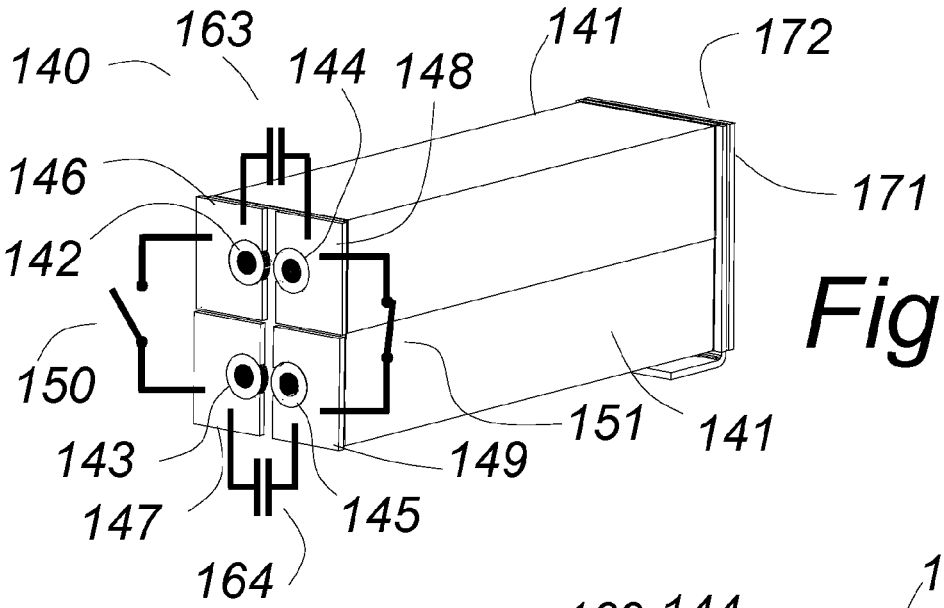
FIG. 18 shows a coaxial push pull module having a symmetrical push pull secondary connection, with the components shown in exaggerated detail.
Figure 19:
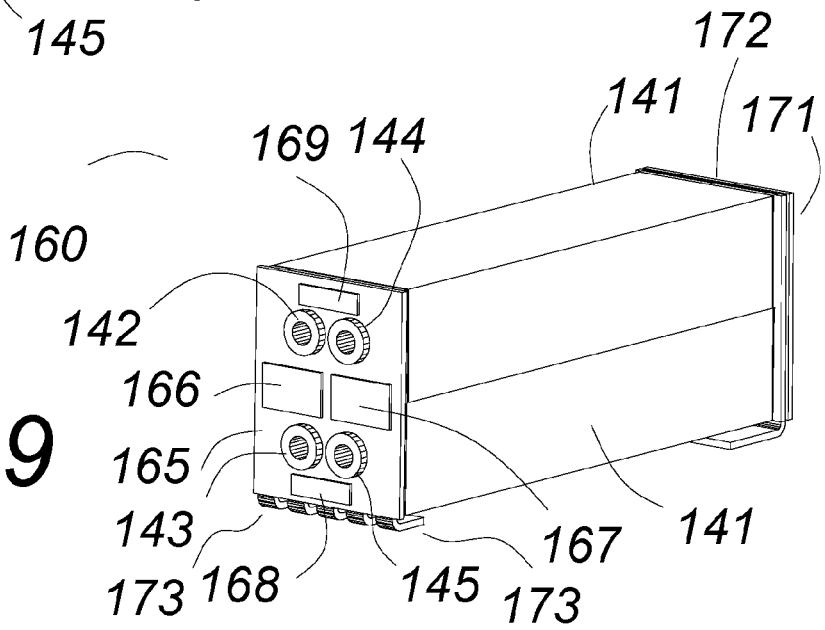
FIG. 19 shows that the switching end of the module of FIG. 18 may be implemented with a circuit board that is directly connected to the secondary windings.
Figure 20:
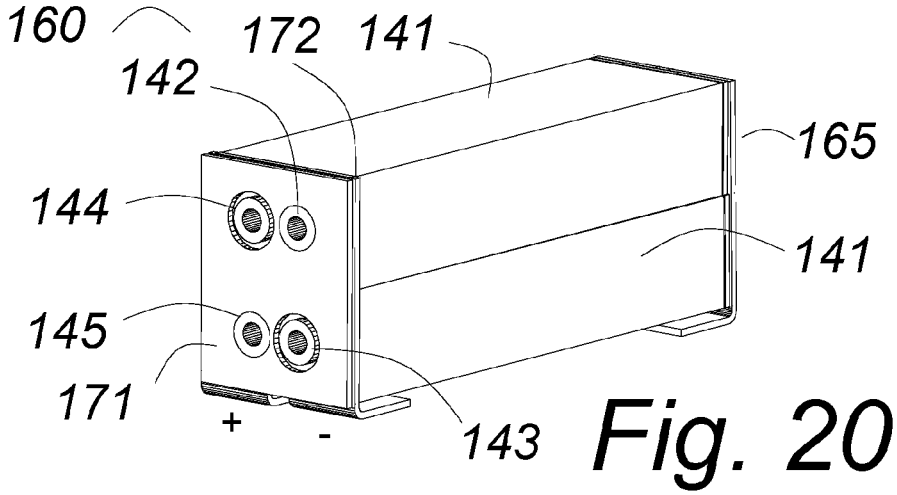
FIG. 20 shows that the dc connection end of the module of FIG. 18 may be implemented with power and ground planes that are directly connected to the secondary windings.
Figure 21:
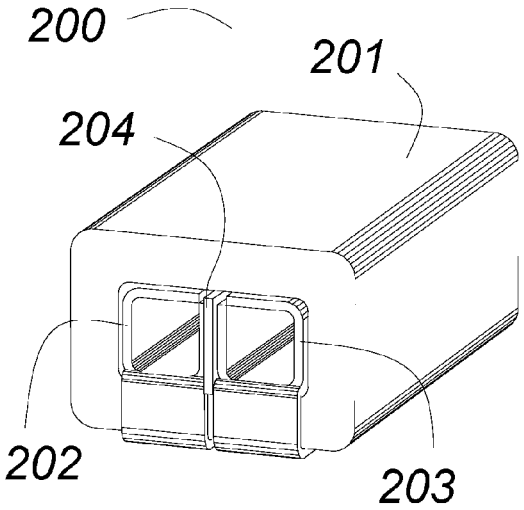
FIGS. 21 through 24 show that an module for a coaxial push pull transformer may be made using a magnetic core with folded metal inserts as the secondary windings.
Figure 22:
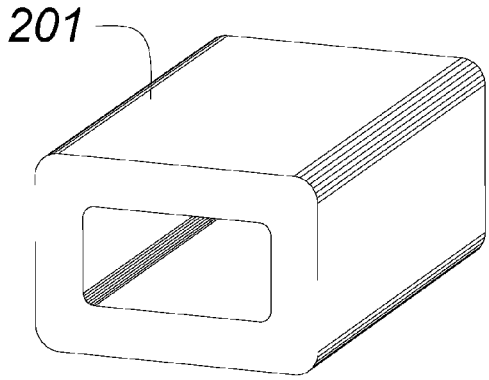
Figure 23:
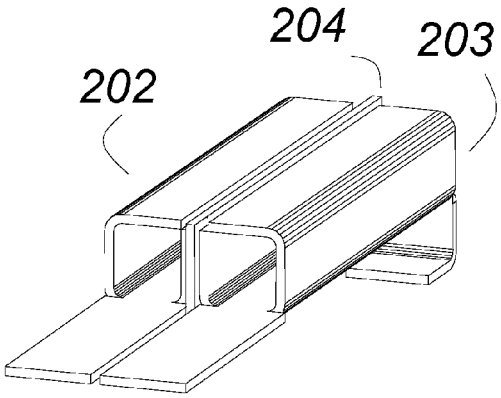
Figure 24:
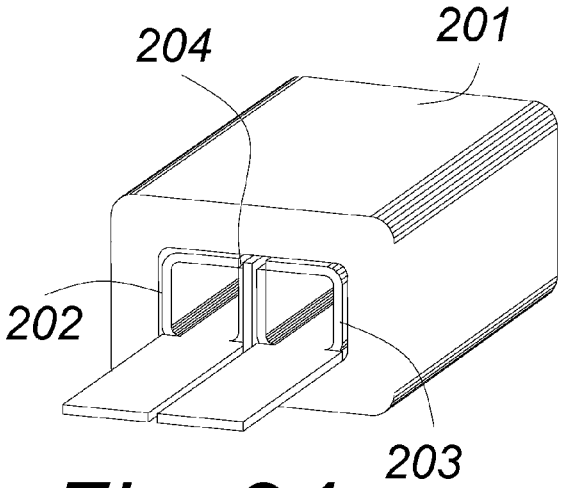

FIGS. 18 through 20 show modules 140 and 160 which are secondary modules arranged and connected so that the secondary windings thereon are symmetrical push-pull secondary windings. The symmetrical push-pull secondary winding may be seen in the schematic of FIG. 30, which is discussed further below. The modules 140 and 160 comprises two magnetic cores 141, 141 surrounding tubular secondary windings 142 through 145. The tubular secondary windings are terminated on one end of the element 140 by four termination plates 146 through 149. The tubular secondary windings 142 through 145 are connected at the other end of the element by a power plane 171 and a ground plane 172, which are in turn the positive + and negative − secondary power output connections for the modules 140 and 160, as shown in FIGS. 18 through 20, but more particularly in FIG. 20.

In FIG. 18, the first tubular secondary winding 142 is connected to the secondary tubular winding 143 when a first switching means 150 is closed, and the third tubular secondary winding 144 is connected to the fourth tubular secondary winding 145 when a second switching means 151 is closed. The element 140 may also have floating capacitors 163 and 164.

In FIG. 19, the switching means 150 and 151 of FIG. 18 are replaced by solid state switching means 166 and 167, which may, as examples, not limitations, be rectifier die, Schottky rectifier die or metal oxide silicon field effect transistor (MOSFET) die as synchronous rectifiers. The solid state switching means 166 and 167 may be mounted on a circuit board 165 that in turn is soldered to the tubular secondary windings 142 through 145. Chip capacitors 168 and 169 may also be mounted on the circuit board 165 and connected as floating capacitors. If the solid state switching means 166 and 167 are synchronous rectifiers, timing and control may be from external circuitry (not shown) which may connect to the module 160 through a plurality of control terminals 173—173. More, fewer or no control terminals may be needed in a particular application. If necessary, the circuit board 165 may extend beyond the face of the magnetic cores 141, 141 in one or more directions, to enable the use of larger components, more components and components on both sides of the circuit board 165, as options.

The symmetrical push-pull secondary module is naturally "folded", and each one will comprise one element of the finished coaxial push pull transformer once it is assembled and the primary windings are installed and terminated.

FIGS. 21 through 24 show an alternate embodiment of the invention. A module 200 comprises a magnetic core 201 and first and second secondary windings 202 and 203 that are formed of a sheet metal conductor material such as copper. A rectangular section is shown where the first and second secondary windings are within the magnetic core 201, as an example, not a limitation, but a "U" shape or round shape would be alternatives. Flat extensions of the first and second secondary windings 202 and 203 may be formed around the edge of the magnetic core 201 at the ends, to make surface mount feet, as shown, as an example, not a limitation. The first and second secondary windings 202 and 203 must be electrically insulated from each other and the magnetic core 201. An insulating insert 204 may be used between the first and second secondary windings 201 and 203, as shown, as an example, not a limitation. Alternatively, the first and second secondary windings 102 and 203 may be coated with an insulating film or they may be installed in an insulating sleeve (in the manner of FIG. 3). As a further alternative, the magnetic core may be coated with an insulating coating.

Figure 25:
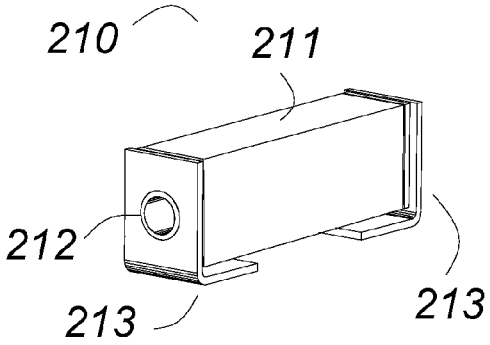
FIG. 25 shows a module comprising a single core with a coaxial secondary winding. This arrangement might be used for a forward converter.
Figure 26:
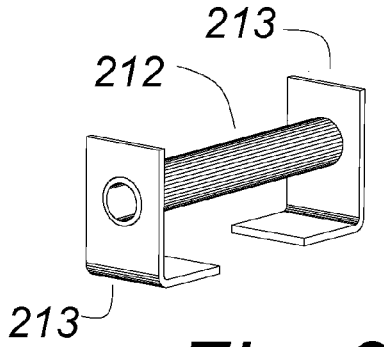
FIG. 26 shows the winding of the module of FIG. 25 without the magnetic core, for clarity.

A push-pull winding is usually a split or center-taped winding wound on a magnetic core, but the teachings of a coaxial winding and closely coupled terminations with counter-flowing currents may be applied to other windings as well. FIGS. 25 shows a module 210 comprising magnetic core 211 having therein a single tubular secondary winding 212, which may be terminated with surface mount terminals 213, 213. FIG. 26 shows the tubular secondary winding 212 and the surface mount terminals 213, 213 without the magnetic core 211, to show more particularly the design of the secondary winding. Because the magnetic core 211 is necessary for a properly functioning transformer, this drawing 26 is for illustration only.

Figure 27:
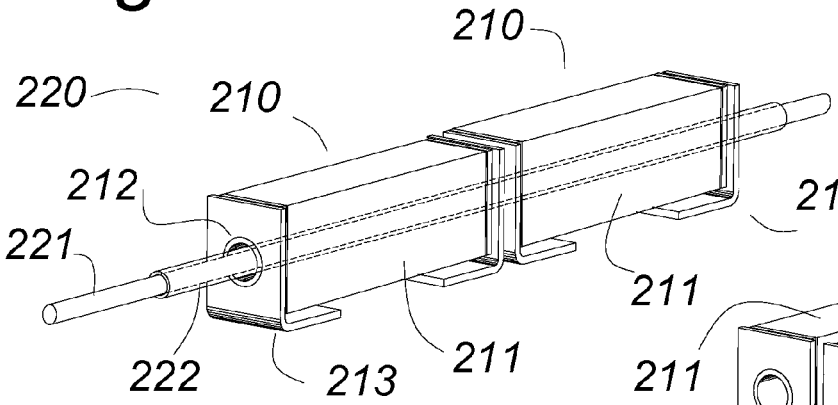
FIG. 27 shows two single core modules, each with a tubular secondary winding. A portion of a primary winding is shown, the whole being a triaxial winding. This arrangement might be used for a forward converter having a separate reset winding.

FIG. 27 shows part of a transformer 220 comprising two of the modules 210 of FIG. 25 placed end to end and further comprising coaxial windings 222 and 221 running through the center hole defined by the tubular secondary winding 212. With the tubular secondary winding 212, the whole comprises a triaxial winding. An outer winding 222 may be the primary winding, and the inner winding 221 may be a reset winding. Such an arrangement could be used for a forward converter having a separate reset winding, as an example, not a limitation.

Figure 28:
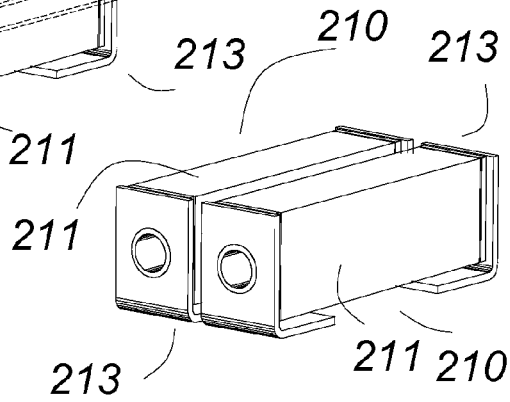
FIG. 28 shows a pair of single turn modules. This arrangement might be used for a double forward converter.
Figure 29:
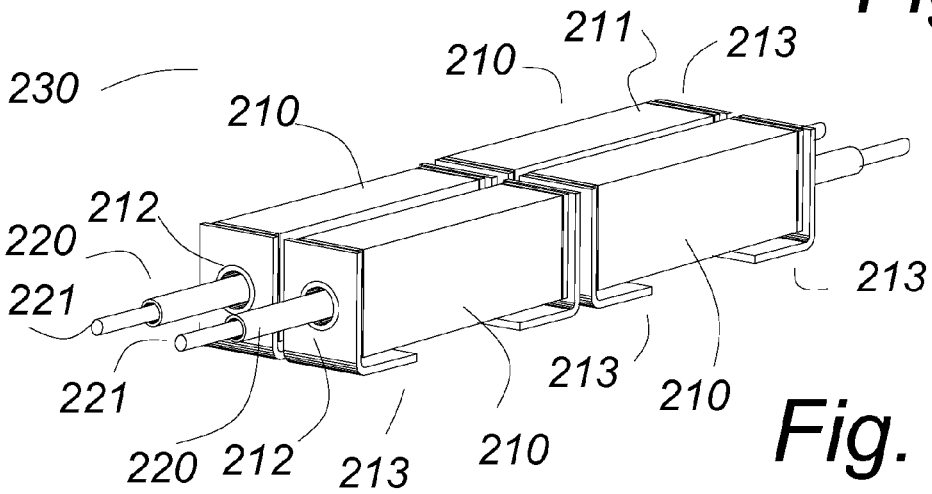
FIG. 29 shows two pairs of single turn modules with triaxial windings. This arrangement might be used for a double forward converter with separate reset windings.
Figure 31:
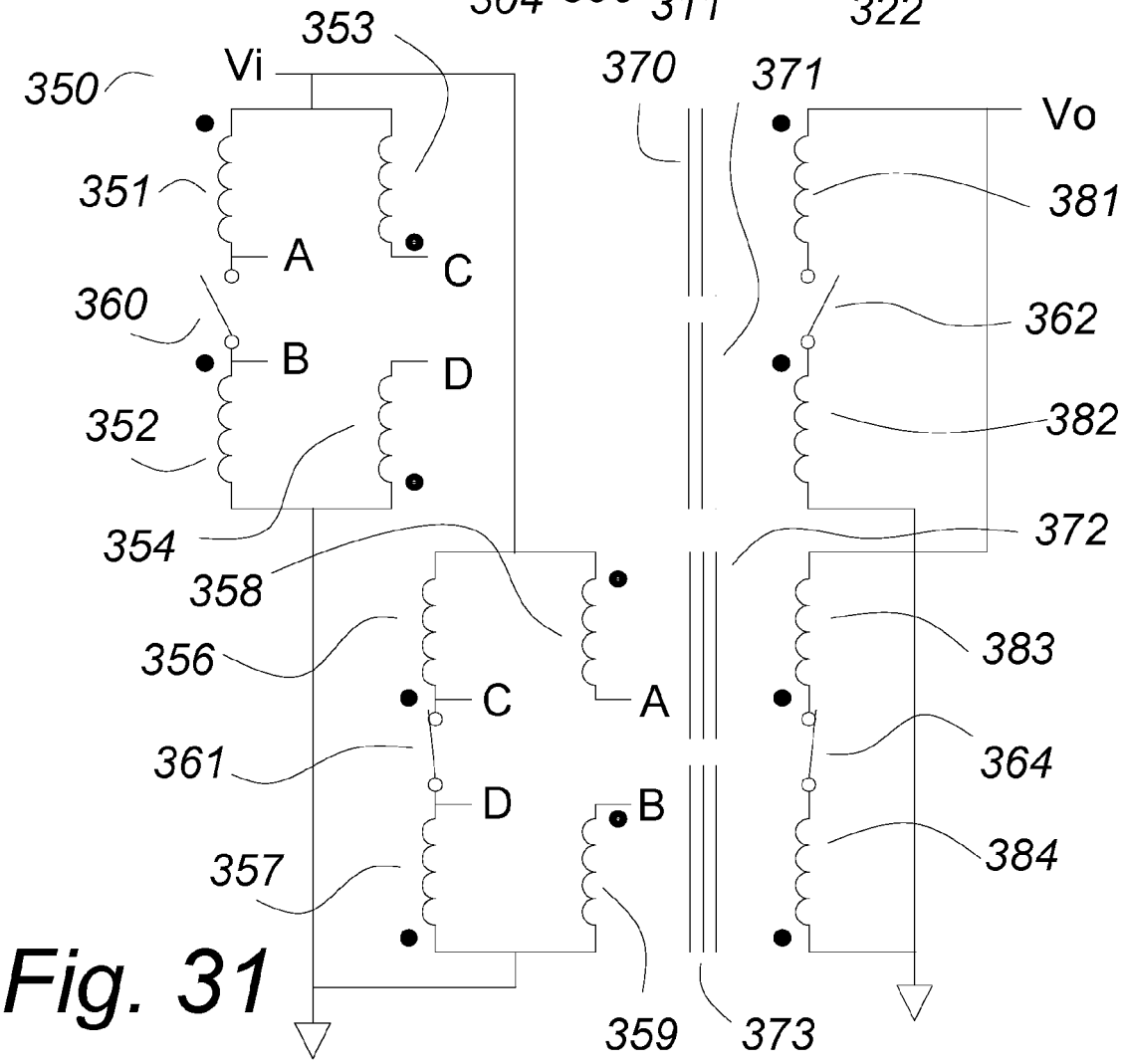
FIG. 31 shows a schematic of a transformer having double forward windings on separate cores. The windings may be triaxial windings with the center conductor used for reset.

FIG. 28 shows that the modules 210 of FIG. 25 may be used in parallel pairs, and FIG. 29 shows a representative partial transformer 230, in which all of the parts can be identified from the above discussions. It is contemplated that this transformer would be completed in the manner of the push-pull transformers above for use as a double forward converter, for example, the manner of FIGS. 7, 8 and 9, 10 through 12 or 16 and 17, as examples, not limitation. FIG. 31 shows a schematic of a representative double forward transformer, and is discussed further below. A forward converter is usually excited with power pulses of one polarity, and there are a large number of schemes to provide a reset pulse of opposite polarity, any of which can be used with the transformer 230 of FIG. 29. However, it is contemplated that the transformer (completed as discussed above) could be energized as a push-pull transformer using the outer windings 222, 222 as the primary windings, just as if the windings were in a double core rather than two single cores. Then the inner windings 221, 221 could then be cross coupled to the other side to provide a reset excitation, as shown in FIG. 31.

FIG. 30 shows a representative schematic of a symmetrical push-pull transformer 300. A primary winding 301 comprising four equal primary winding sections 302 through 306 has two switching means 307, 308 symmetrically disposed with respect to a power input Vi and a return. The primary winding sections 301 and 304 may be wound through one or more first cores 311, and the primary winding sections 302 and 303 may be wound through one or more second cores 312. Alternatively, all of the windings may be wound on a single core, phased as shown, it being electrically equivalent, but the two or more core example is more representative of the coaxial push-pull transformers discussed above.

FIG. 30 also shows a symmetrical push pull secondary winding 320 comprising four equal secondary winding sections 321 through 324. The secondary winding sections 321 and 324 may be wound through the first core 311 and the secondary winding sections 322 and 323 may be wound through the second core 312.

FIG. 30 also shows "floating capacitors" 307, 308, 327 and 328. The physical location of the floating capacitors 307 and 308 is illustrated in FIG. 10 as capacitors 78 and 79. The physical location of the floating capacitors 327 and 328 is illustrated in FIG. 18 as capacitors 163 and 164.

As shown in FIG. 30, if each coil represents a single turn, the transformer will have a one to one turns ration. The schematic may be interpreted more generally, however. If more than one first core 311 and second core 312 is used, there may be a plurality of secondary winding sections 321 through 324, one set for each pair of cores and wired in parallel. A single primary winding may pass through all of the elements. A physical example of a symmetrical push pull primary winding is shown in FIG. 10, and a physical example of a symmetrical push pull secondary winding is shown in FIG. 18.

The use of a symmetrical push-pull primary winding does not require the use of a symmetrical push-pull secondary winding, and vice versa, either could be a conventional push-pull winding or another configuration such as half bride or full bridge.

FIG. 31 shows a schematic diagram of a representative symmetrical double forward converter 350. The double forward converter 350 has two sections, one above the other in the schematic diagram. A first section comprises two magnetic cores 370 and 371 which may have therein triaxial windings. A first secondary section 381 may comprise the outer conductor of a triaxial winding within the first core 370, a first primary winding section 351 may comprise an intermediate conductor of the triaxial winding within the first core 370, and a first reset winding section 354 may comprise the inner conductor of the triaxial winding within the first core 370.

A second secondary section 382 may comprise the outer conductor of a triaxial winding within the second core 371, a second primary winding section 352 may comprise an intermediate conductor of the triaxial winding within the second core 371, and a second reset winding section 353 may comprise the inner conductor of the triaxial winding within the second core 371.

A third secondary section 383 may comprise the outer conductor of a triaxial winding within the third core 372, a third primary winding section 356 may comprise an intermediate conductor of the triaxial winding within the third core 372, and a third reset winding section 359 may comprise the inner conductor of the triaxial winding within the third core 372.

A fourth secondary section 384 may comprise the outer conductor of a triaxial winding within the fourth core 373, a fourth primary winding section 357 may comprise an intermediate conductor of the triaxial winding within the fourth core 373, and a fourth reset winding section 358 may comprise the inner conductor of the triaxial winding within the fourth core 373.

A first switching means 360 connects the first primary section 351 to the second primary section 352 when the first switching means 360 is on. A second switching means 361 connects the third primary section 356 to the fourth primary section 357 when the second switching means 361 is on.

A third switching means 362 connects the first secondary section 381 to the second secondary section 382 when the third switching means 362 is on. A fourth switching means 364 connects the third secondary section 383 to the fourth secondary section 384 when the fourth switching means 364 is on.

To avoid cluttering the schematic, four tie points A, B, C and D have been shown, it being understood that connecting like lettered tie points to each other shows one way in which the reset windings 353, 354, 358 and 359 may be energized.

The separate reset winding has several advantages. One is that the power excitation and the reset excitation can be separately controlled. The power pulses could overlap somewhat without shorting the windings through the transformer coupling. In a conventional transformer, the coupling between the primary winding and the reset winding would have significant leakage inductance, but the triaxial winding arrangement of the present invention would have near perfect coupling for extremely low leakage inductance.

The single core with the single tubular winding has the advantage that the core to the winding may not need to be insulated, allowing a tighter fit between the core and the winding, which in turn allows the core volume to be smaller and the thermal coupling to be greater.

What is claimed is:

1. A coaxial push-pull transformer comprising a plurality of coaxial push pull modules, the coaxial push-pull modules comprising at least a first magnetic core having a through hole therein, a first tubular secondary windings extending through the through hole in the at least a first magnetic core, the first tubular secondary winding being a first half of a push pull secondary winding, a second tubular secondary windings extending through the through hole in the at least a first magnetic core, the second tubular secondary winding being a second half of a push pull secondary winding, means for terminating the first and second tubular secondary windings for connection to an electrical circuit, means for insulating the first tubular secondary winding from the second tubular secondary winding and for insulating the first and second tubular secondary windings from the at least a first magnetic core, the plurality of coaxial push-pull modules being arranged and disposed so that the first and second tubular secondary windings are aligned from one coaxial push-pull module to the next, a first primary winding passing through the first tubular secondary windings of the plurality of coaxial push pull modules such that the first tubular secondary windings surround the first primary winding coaxially, a second primary winding passing through the second tubular secondary windings of the plurality of coaxial push pull modules such that the second tubular secondary windings surround the second primary winding coaxially, and means for terminating the first and second primary windings for connection to an electrical circuit.

2. The coaxial push-pull transformer of claim 1 wherein at least two of the means for terminating the first and second tubular secondary windings of the plurality of coaxial push pull modules and the means for terminating the first and second primary windings are terminals carrying counter-flowing currents, and the at least two terminals carrying counter-flowing currents are proximate one to the other for magnetic field cancellation for reduced circuit inductance.

3. The coaxial push-pull transformer of claim 1 further comprising at least a first circuit board between adjacent coaxial push pull modules of the coaxial push pull transformer, the at least a first circuit board being connected to the means for terminating the first and second tubular secondary windings of at least one of the plurality of coaxial push-pull modules.

4. The coaxial push pull transformer of claim 1 wherein the plurality of coaxial push pull modules have push-pull secondary windings that are connected as "symmetrical push-pull" secondary windings.

5. The coaxial push-pull transformer of claim 1 wherein the first and second primary windings are connected as a "symmetrical push-pull" primary winding.

6. A coaxial push-pull module for a coaxial push pull transformer, the coaxial push-pull module comprising at least a first magnetic core having a through hole therein, a first tubular secondary windings extending through the through hole in the at least a first magnetic core for receiving a first primary winding coaxially therein, the first tubular secondary winding being a first half of a push pull secondary winding, a second tubular secondary windings extending through the through hole in the at least a first magnetic core for receiving a second primary winding coaxially therein, the second tubular secondary winding being a second half of a push pull secondary winding, means for terminating the first and second tubular secondary windings for connection to an electrical circuit, and means for insulating the first tubular secondary winding from the second tubular secondary winding and for insulating the first and second tubular secondary windings from the at least a first magnetic core.

7. The coaxial push-pull module of claim 6 further comprising a circuit board located proximate to the coaxial push-pull module, and the circuit board being connected to the means for terminating the first and second tubular secondary windings.

8. The coaxial push-pull module of claim 6 wherein the first and second tubular secondary windings are connected as a "symmetrical push pull" winding.

9. A coaxial double forward transformer comprising a plurality of coaxial module, the plurality of coaxial modules comprising at least a first magnetic core having a through hole therein, a tubular secondary winding extending through the through hole in the at least a first magnetic core, means for terminating the tubular secondary winding for connection to an electrical circuit, the plurality of coaxial modules being arranged and disposed in first and second rows, side by side, such that the tubular secondary windings of the plurality of coaxial modules are aligned in each of the first and second rows, one coaxial module to the next, first and second coaxial conductors pass through the tubular secondary windings respectively in the first and second rows of the plurality of coaxial modules, the coaxial conductors comprising an inner conductor and an outer conductor, the outer conductors of the first and second coaxial conductors comprise first and second primary windings, the inner conductors of the first and second coaxial conductors comprise first and second reset windings, and means for terminating the first and second primary windings and the first and second reset windings for connection to an electrical circuit.

* * * * *